US006367723B1

(12) United States Patent
Kircher et al.

(10) Patent No.: US 6,367,723 B1
(45) Date of Patent: Apr. 9, 2002

(54) SIZE REDUCTION MACHINE HAVING AN ADJUSTABLE IMPELLER AND SCREEN HOLDER

(75) Inventors: Albert Kircher, Burr Ridge; Thomas E. Sotomayor, Streamwood; Ronald D. Selner, Lisle; Elbert D. Wilson, Northlake, all of IL (US)

(73) Assignee: The Fitzpatrick Company, Elmhurst, IL (US)

( * ) Notice: Subject to any disclaimer, the term of this patent is extended or adjusted under 35 U.S.C. 154(b) by 0 days.

(21) Appl. No.: 09/499,414

(22) Filed: Feb. 7, 2000

(51) Int. Cl.[7] ..... B02C 17/02

(52) U.S. Cl. ..... 241/69; 241/74; 241/73; 241/89.1; 241/89.2

(58) Field of Search ..... 241/69, 73, 74, 241/86.1, 89.1, 89.2, 89.3; 209/245, 276, 278, 405, 411

(56) References Cited

U.S. PATENT DOCUMENTS

| | | | | |
|---|---|---|---|---|
| 2,780,417 A | | 5/1957 | Harris | |
| 3,693,893 A | | 9/1972 | McIntyre | |
| 4,605,173 A | | 8/1986 | Edmonds | |
| 4,611,766 A | | 9/1986 | Seifert | |
| 4,759,507 A | | 7/1988 | Lynch et al. | |
| 4,768,722 A | | 9/1988 | Lynch et al. | |
| 4,773,599 A | | 9/1988 | Lynch et al. | |
| 5,261,612 A | | 11/1993 | Fraiha | |
| 5,282,579 A | | 2/1994 | Poser et al. | |
| 5,330,113 A | | 7/1994 | Poser et al. | |
| 5,417,145 A | * | 5/1995 | Joseph, Jr. et al. | 99/280 |
| 5,505,392 A | | 4/1996 | Tunnicliffe et al. | |
| 5,804,075 A | * | 9/1998 | Aikawa | 210/497.01 |
| 5,855,160 A | * | 1/1999 | Shen | 99/279 |
| 6,050,180 A | * | 4/2000 | Moline | 99/511 |
| 6,051,103 A | * | 4/2000 | Aikawa | 162/55 |
| 6,179,231 B1 | * | 1/2001 | Csendes | 241/19 |
| 6,186,428 B1 | * | 2/2001 | Robinson et al. | 241/65 |

* cited by examiner

*Primary Examiner*—Allen Ostrager
*Assistant Examiner*—William Hong
(74) *Attorney, Agent, or Firm*—McDonnell Boehnen Hulbert & Berghoff

(57) ABSTRACT

Size reduction machines including a screen holder that positions and secures a screen associated with the size reduction machine in place and also including an adjustable impeller for setting and changing a desired known gap between the size reduction machine impeller and frusto-conical screen.

7 Claims, 11 Drawing Sheets

SIZE REDUCTION MACHINE HAVING AN ADJUSTABLE IMPELLER AND SCREEN HOLDER

BACKGROUND OF THE INVENTION (1) Field of the Invention

This invention concerns size reduction machines, and in particular to a screen holder for use with a size reduction machine that positions and compressively locks a screen associated with the size reduction machine in place. This invention also relates to a mechanism for setting the gap between the impeller and the screen of a size reduction machine. This invention further relates to size reduction machines that can be easily disassembled for cleaning.

(2) Description of the Art

Maintaining the gap between the impeller and the screen of a size reduction machine is important in controlling product particle size. Therefore, it is imperative that the gap dividing the size reduction machine impeller from the size reduction machine screen is held constant during size reduction machine use. Furthermore, since a variety of screen sizes and impeller designs can be used within a single size reduction machine to produce products having a wide range of particle sizes, it additionally becomes important to be able to consistently adjust the gap between the size reduction machine screen and the size reduction machine impeller to control product particle size. Being able to adjust the impeller/screen gap is also important to maintain geometric screen uniformity because any non-uniformity such as warpage can detrimentally effect product particle size and/or particle size distribution.

Some size reduction machines of the prior art use frusto-conical shaped screens located in a channel between an input and an output. Such a size reduction machine is disclosed, for example, in U.S. Pat. No. 4,759,507, which describes using various screen openings of varying size and shape and using various impeller types to control particle size. According to the '507 patent, once a screen and impeller have been selected, the operation and efficiency of the machine depends upon the gap between the impeller and the interior wall surface of the screen. With the '507 patent device, different wall thickness screens are compensated for by inserting or removing spacers on the impeller shaft in order to move the impeller relative to the interior wall surface of the screen. Since the wall of the screen is tapered relative to the impeller, the actual adjustment of the gap is less than the thickness of the spacer and depends upon the angle of the screen relative to the horizontal. Where the tapered wall of the screen has an angle of sixty degrees relative to the horizontal, the gap is adjusted by one half the thickness of the spacer.

The use of spacers to control the screen/impeller gap creates difficulties. The process of installing a spacer and repeatedly removing and replacing incremental spacers is time consuming. Further, since the spacers must be incrementally sized and machined, the cost of producing such spacers is relatively high. Spacers are also easily lost during cleaning which can lead to re-assembly of the size reduction machine with an improper gap setting and decreased performance.

Adjustable size reduction machines without spacers are known in the art. For example, U.S. Pat. Nos. 4,773,599, 4,759,507, and 4,768,722 disclose machines in which the gap between the impeller and the screen is determined by the thickness of the screen flange or in which the gap is set by indexing the axial position of the impeller shaft when the machine is not in operation.

U.S. Pat. No. 5,282,579 discloses a size reduction machine with an adjustable impeller shaft. The impeller shaft is constructed in two parts that are united by a spacer device that operates much like a caliper to adjust the impeller shaft length, and thereby the gap between the impeller and the screen. One problem with the '579 patent device is that the gap cannot be adjusted after the size reduction machine is assembled.

U.S. Pat. No. 4,605,173 discloses a size reduction machine with an adjustable stop for limiting the maximum travel of the impeller into the frusto-conical screen. U.S. Pat. No. 5,505,392 discloses a size reduction machine having an adjustable length rotary drive coupling. The coupling includes two rotary shafts, one of which has at least one tooth and the second of which includes varying depth abutment surfaces. The union of a tooth with an abutment surface sets the gap between the impeller and the frusto-conical screen of the size reduction machine.

Despite the advances made in size reduction machine design, there remains a need for size reduction machines with improved mechanisms for setting the impeller to screen gap. Specifically, there remains a need to be able to provide simple, positive and accurate incremental adjustment of the screen to impeller gap without disassembling the size reduction machine. In addition there is a need for devices that maintain geometry of a frusto-conical screen and its concentric alignment with respect to the impeller shaft. There is further a need for a size reduction machine that is easily disassembled for cleaning.

SUMMARY OF THE INVENTION

It is an object of this invention to provide a screen holder for a size reduction machine that maintains the geometric integrity of a size reduction machine screen.

It is another object of this invention to provide a screen holder that is able to compressively secure a size reduction machine screen in an axial position.

A further object of this invention is to provide a screen holder that is able to concentrically position the screen with respect to the impeller shaft.

Yet another object of this invention is a screen holder that re-forms or re-shapes warped screens.

It is a further object of this invention to provide a mechanism for easily adjusting and setting the gap between the impeller and screen associated with a size reduction machine. Yet another object of this invention is to provide a positive, incremental, reproducible and known gap between impeller and screen associated with a size reduction machine.

In one embodiment, this invention is a screen holder for use with a size reduction machine. The screen holder comprises several elements including a first flange having a top surface, a bottom surface and an opening wherein the first flange bottom surface includes a screen pilot. The screen holder further includes a second flange having a second opening. Finally, the screen holder includes at least one support arm uniting the first flange with the second flange.

In another embodiment, this invention includes an adjustable impeller for use with a size reduction machine. The adjustable impeller comprises several elements including an impeller having at least one arm and a hub including central aperture wherein the central aperture includes a threaded portion. The adjustable impeller further includes an impeller drive shaft associated with the drive mechanism and having a first end and a second end associated with the drive housing wherein the impeller drive shaft includes a threaded portion that is complementary to the impeller central aperture threaded portion.

In yet another embodiment, this invention includes a method for setting a gap between an impeller and a frusto-conical screen of a size reduction machine where the size reduction machine includes an impeller drive shaft, and a drive mechanism. The gap is set by rotating the impeller which includes at least one arm attached to a hub having a central aperture that further includes a threaded portion in relation to an impeller drive shaft having a first end and a second end associated with the drive mechanism wherein the impeller drive shaft includes threads complementary to the impeller central aperture threaded portion and wherein the relative rotation causes the threaded portion of the impeller central aperture to engage with the threaded portion of the impeller drive shaft. The relative rotation of the impeller with respect to the impeller drive shaft is continued until at least one impeller arm contacts the frusto-conical screen. Once an impeller arm contacts the frusto-conical screen, the impeller is rotated in relationship to the impeller drive shaft to cause the impeller central aperture threaded portion to disengage at least partially from the impeller drive threaded portion to form a gap between the impeller arm and the frusto-conical screen.

DESCRIPTION OF THE CURRENT EMBODIMENT

The present invention relates to size reduction machines. More particularly, the present invention relates to size reduction machines including at least one of several features including a novel screen holder, a novel impeller/screen gap adjustment mechanism, a construction that allows the size reduction machine product contact parts to be easily disassembled and cleaned, a reversion ledge associated with the infeed hopper for preventing product ejection, and a single safety switch mechanism that prevents the size reduction machine from being operated unless the machine is completely assembled.

Figure 1:
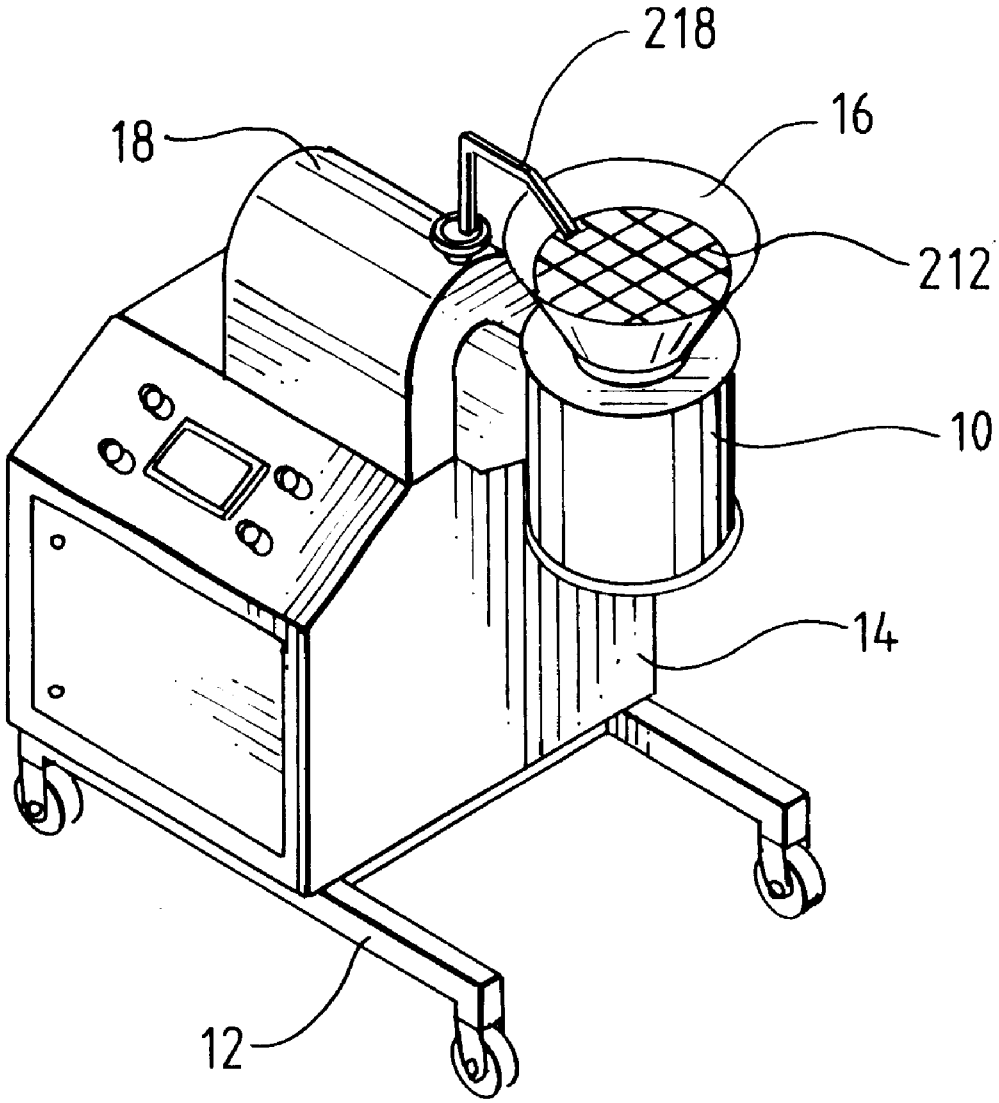
FIG. 1 is a perspective view of a size reduction machine of this invention.

Shown in FIG. 1 is a perspective view of a size reduction machine 10 of this invention. Size reduction machine 10 rests on housing 14 which in turn rests upon wheeled stand 12. Size reduction machine 10 further includes an inlet feed hopper 16 in which material to be reduced in size in introduced. Also shown is motor housing 18 that covers a motor or other drive mechanism.

Figure 2:
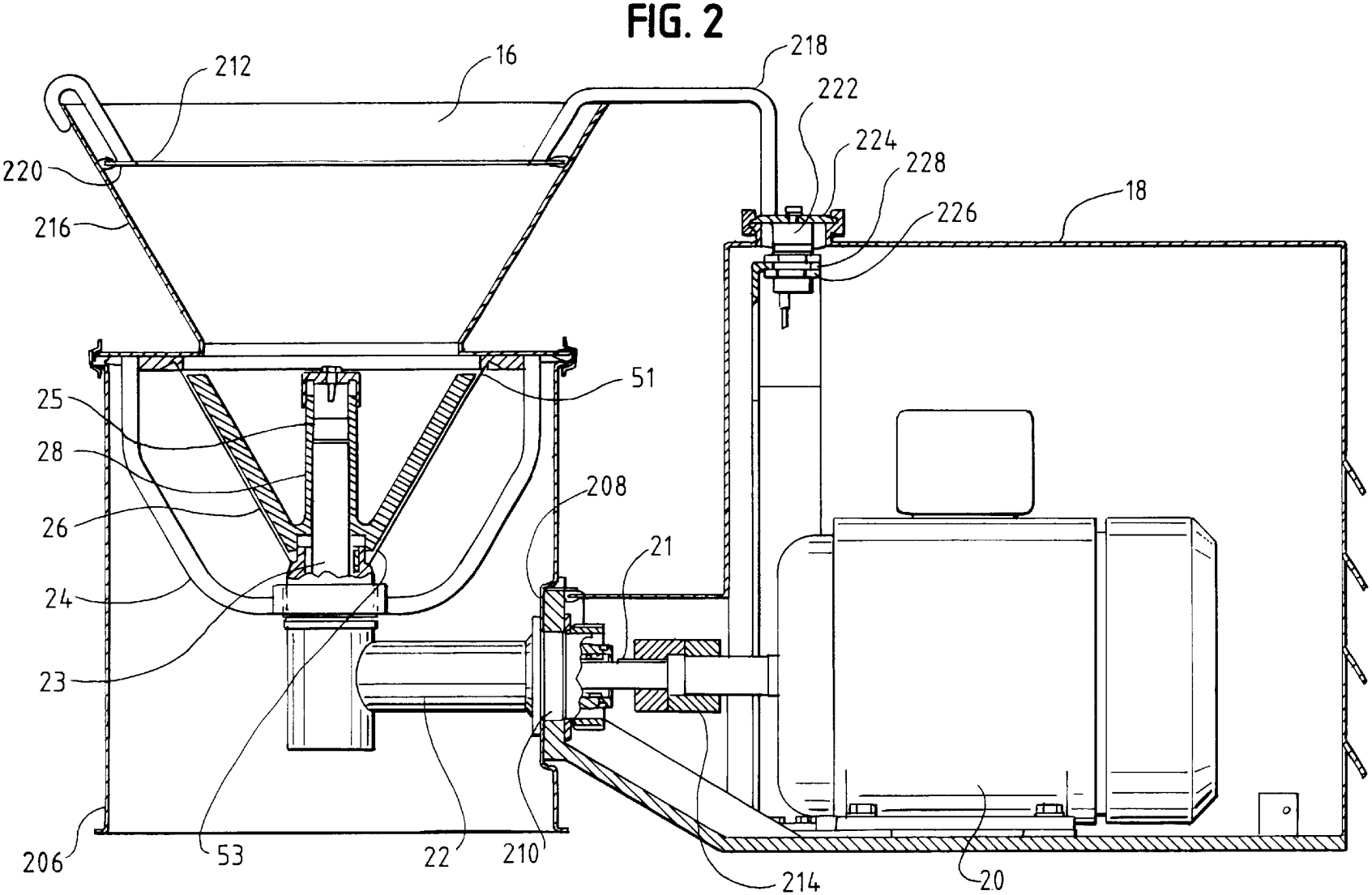
FIG. 2 is a side cross section view of a size reduction machine of this invention.

FIG. 2 is a cross section view of a size reduction machine including several features of this invention. Size reduction machine 10 includes motor 20 which is associated by motor drive shaft 21 to right angle gearbox 22. Right angle gearbox 22 is associated with impeller drive shaft 23 such that rotation of motor drive shaft 21 is transferred by right angle gearbox 22 to impeller drive shaft 23 thereby causing impeller 28 to rotate. Impeller 28 includes at least one arm 30 connected to impeller hub 25.

Figure 3C:
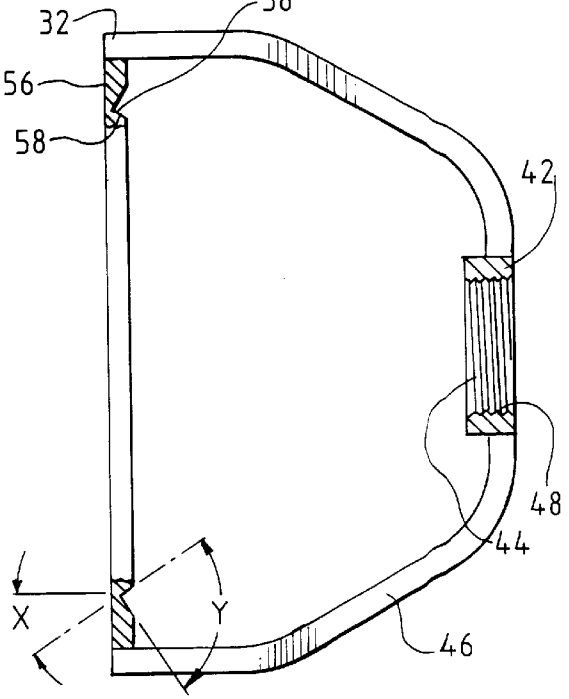
FIGS. 3A–3C are side, top, and side cut-away views of a screen holder of this invention.
Figure 3B:
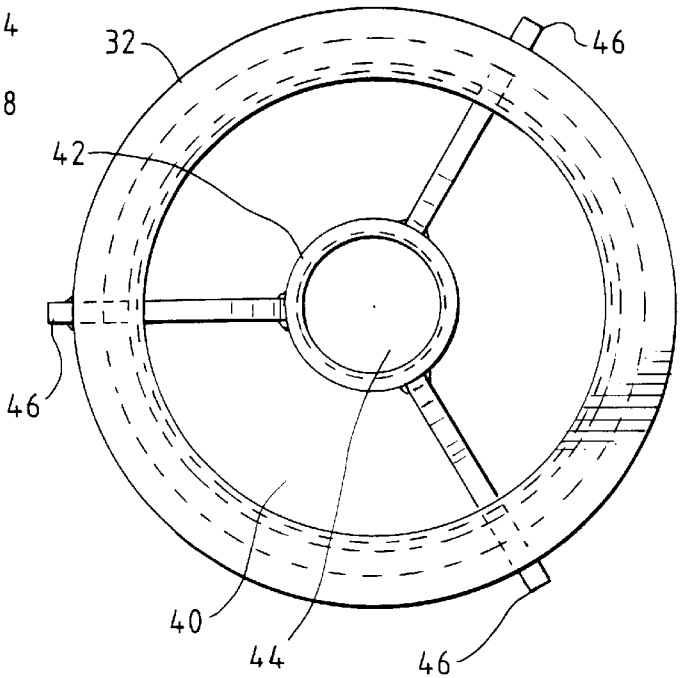
Figure 3A:
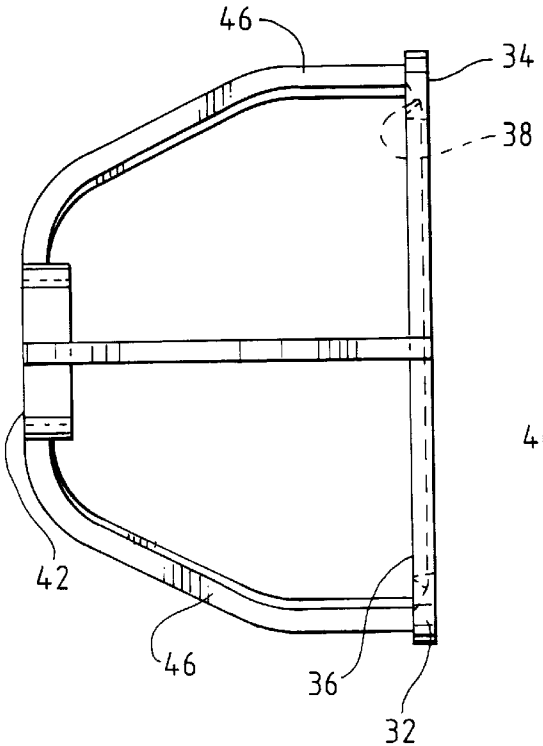

Size reduction machine 10 of this invention further may include a screen holder 24 and screen 26. FIGS. 3A, 3B and 3C are side, top, and side cut-away views respectively of a screen holder 24 of this invention. Screen holder 24 includes first flange 32, a second flange 42 and at least one support arm 46. A preferred screen holder 24, shown in FIGS. 3A–3C, includes three support arms 46 that fixedly unite first flange 32 and second flange 42. First flange 32 includes a first opening 40 while second flange 42 includes a second opening 44. It is preferred that first and second openings 40 and 44 are circular. First opening 40 is sized to be slightly smaller than large opening 50 of screen 26 shown in FIG. 4. Second opening 44 should have a size that is large enough to encompass at least a portion of drive housing cap 107 shown in FIG. 6.

Screen holder first flange 32 further includes a top surface 34, a bottom surface 36 and a screen pilot 38 associated with first flange bottom surface 36. Screen pilot 38 may be any geometric feature associated with first flange bottom surface 36 that gently urges large opening 50 of frusto-conical screen 26 outwards as screen holder 24 is being associated with a drive mechanism.

Figure 6:
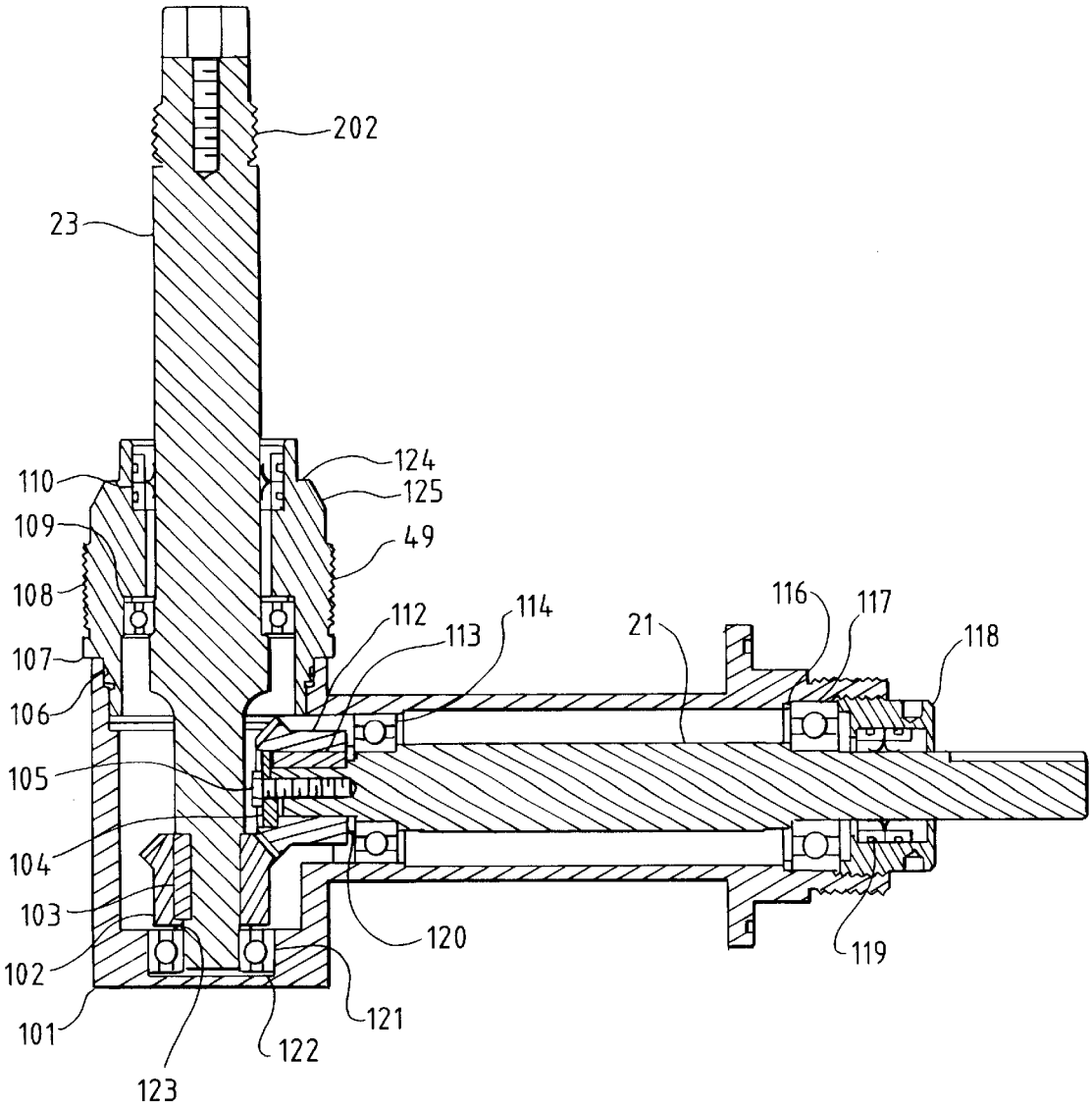
FIG. 6 is a side cut-away view of a right angle gear box useful in the present inventions.

Screen holder second flange 42 is united with drive housing cap 107 to thereby secure screen holder 24 to drive housing 18. More preferably, second opening 44 of second flange 42 includes an inside wall 48 that is threaded. Threaded inside wall 48 of second flange 42 is complimentary to threaded portion 49 on the outer surface of drive housing cap 107 as shown in FIG. 6.

Second flange 42 of screen holder 24 may be associated with any type of drive mechanism that is typically used in size reduction machines. Examples of useful drive mechanisms and/or motors are disclosed below. It is important that any drive mechanism used with screen holder 24 include a housing such as housing cap 107 to which screen holder second flange 42 is secured. For purposes of description only, the second flange 42 of screen holder 24 is associated with drive housing cap 107 which is part of a right angle gear box 22.

Screen holder 24 may be used in conjunction with just about any screen normally used in size reduction machines. Such screens are generally cylindrical or frusto-conical in shape and screen holder 24 of this invention can be used equally well with both types of screens. For purposes of description only, we will discuss the use of screen holder 24 in conjunction with frusto-conical screen 26.

Screen 26 is positioned and compressively secured in place using screen holder 24 by placing frusto-conical screen 26 in screen holder 24 and then passing impeller drive shaft 23 through the apertures formed by frusto-conical screen small opening 52 and through opening 44 associated with screen holder second flange 42 until the threads on inside wall 48 of screen holder second flange 42 engage threaded portion 49 of drive housing cap 107. At this point, frusto-conical screen rim portion 51 near large opening 50 should be at least partially engaged with screen pilot 38. Also at this point, frusto-conical screen rim portion 53 associated with frusto-conical screen small opening 52 should rest on shoulder 125 of drive housing cap 107. Next, screen holder 24 is indexed towards drive housing cap 107 preferably by threading screen holder 24 onto drive housing cap 107. As screen holder 26 is being threaded onto drive housing cap 107, frusto-conical screen 26 is slightly compressed between shoulder 125 and first flange bottom surface 36. As screen compression is occurring, screen pilot 38 engages inner rim portion 51 of frusto-conical screen large opening 50 and forces the screen large opening outwards to conform with the dimensions of screen pilot 38 which is preferably circular. The piloting action causes frusto-conical screen to assume a circular form defined by screen pilot 38 thereby significantly reducing any screen warpage. Indexing screen holder 24 towards drive housing cap 107 also compresses frusto-conical screen rim portion 53 against shoulder 125 of drive housing cap 107. Shoulder 125 is preferably tapered or inwardly angled. Giving shoulder 125 an inward angle forces inner rim portion 53 of frusto-conical screen 26 slightly outwards thereby reducing any warpage of frusto-conical screen 26 near small opening 52.

The screen holder of this invention will perform at least one of the following functions when screen 26 is compressed between screen holder 24 and the drive housing: (1) the screen holder will compressively secure the screen in an axial position; (2) the screen holder will prevent the screen from rotating about the screen axis when the screen and screen holder are properly installed; (3) the screen holder concentrically positions the screen with respect to the impeller drive shaft; and/or (4) the screen holder re-forms and re-shapes the screen to correct any screen warpage.

Figure 9A:
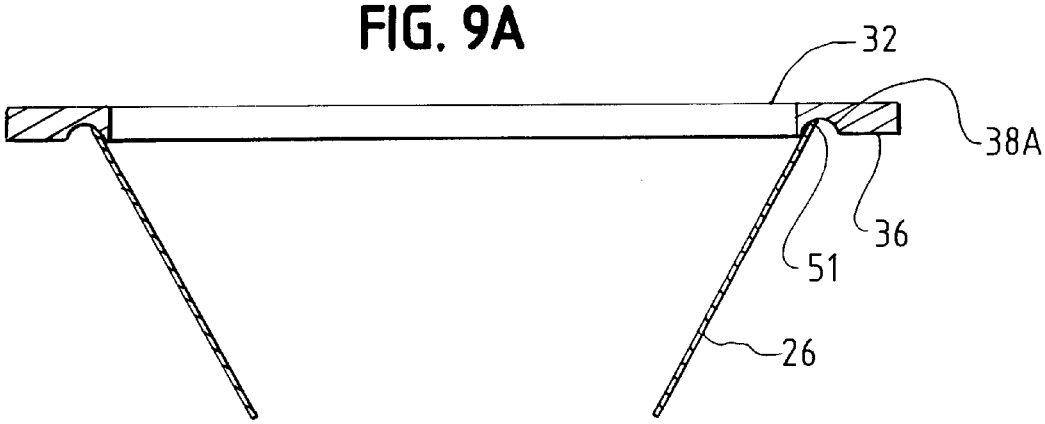
FIGS. 9A–9F are cross section views of embodiments of screen pilots of this invention.
Figure 9B:
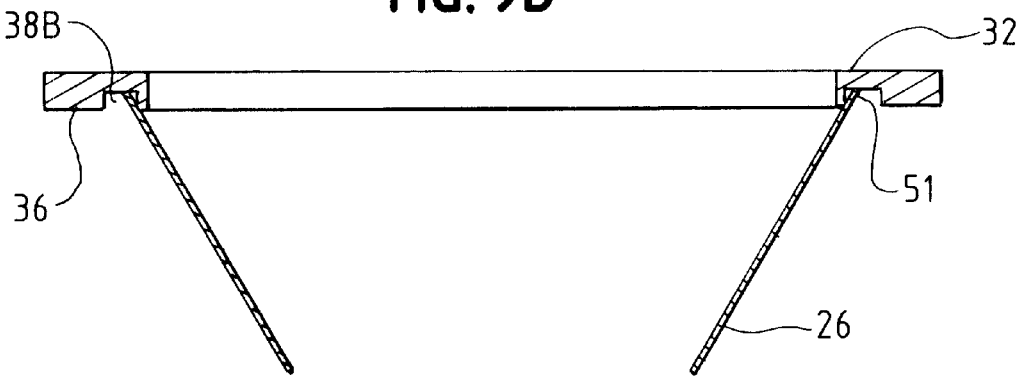
Figure 9C:
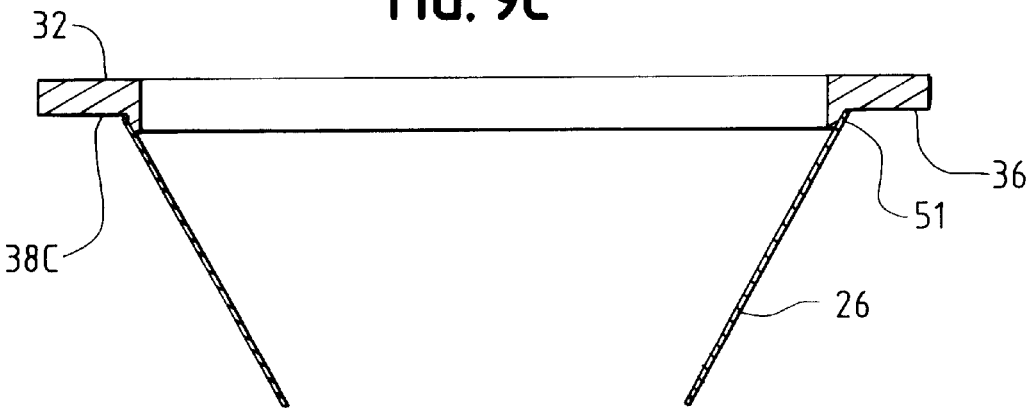
Figure 9D:
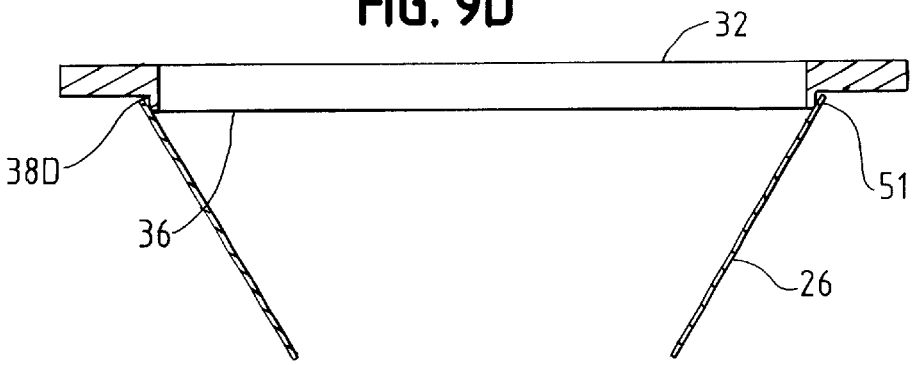
Figure 9E:
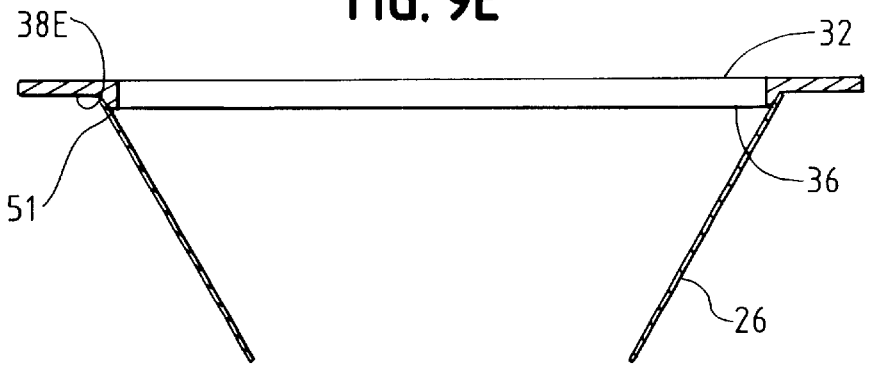
Figure 9F:
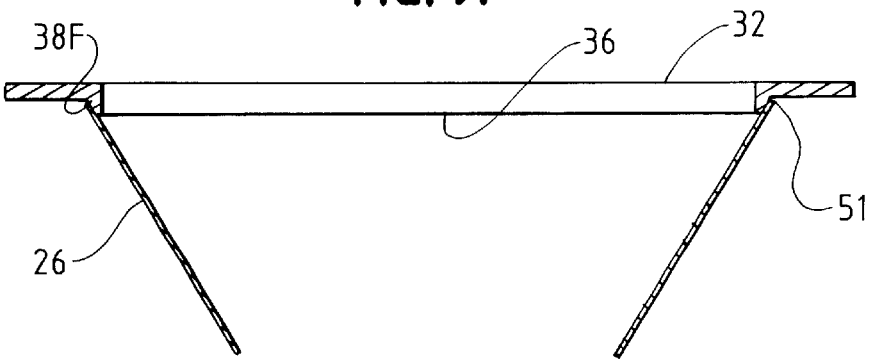

As shown in FIGS. 9A–9F, screen pilots 38 may be of any shape or design that is capable of urging frusto-conical screen 26 into its frusto-conical geometric configuration. For example, screen pilot 38 may be a raised convex, concave or straight angled wall (See 38C, 38D, 38E, 38F as shown in FIGS. 9C–9F), it may a circular or angled channel (38A and 38B as shown in FIGS. 9A and 9B), it may be a plurality of posts (38G in FIG. 10) which together define a circle on bottom surface 36 of first flange 32, or screen pilot 38 may take on any other shape or form that acts as a screen pilot. The size, shape, and configuration of screen pilot 38 is not critical. What is important is that screen pilot 38 is configured to uniformly contact inner rim portion 51 of frusto-conical screen large opening 50 as frusto-conical screen 26 is being slightly compressed between screen holder first flange 32 and shoulder 125.

Figure 10:
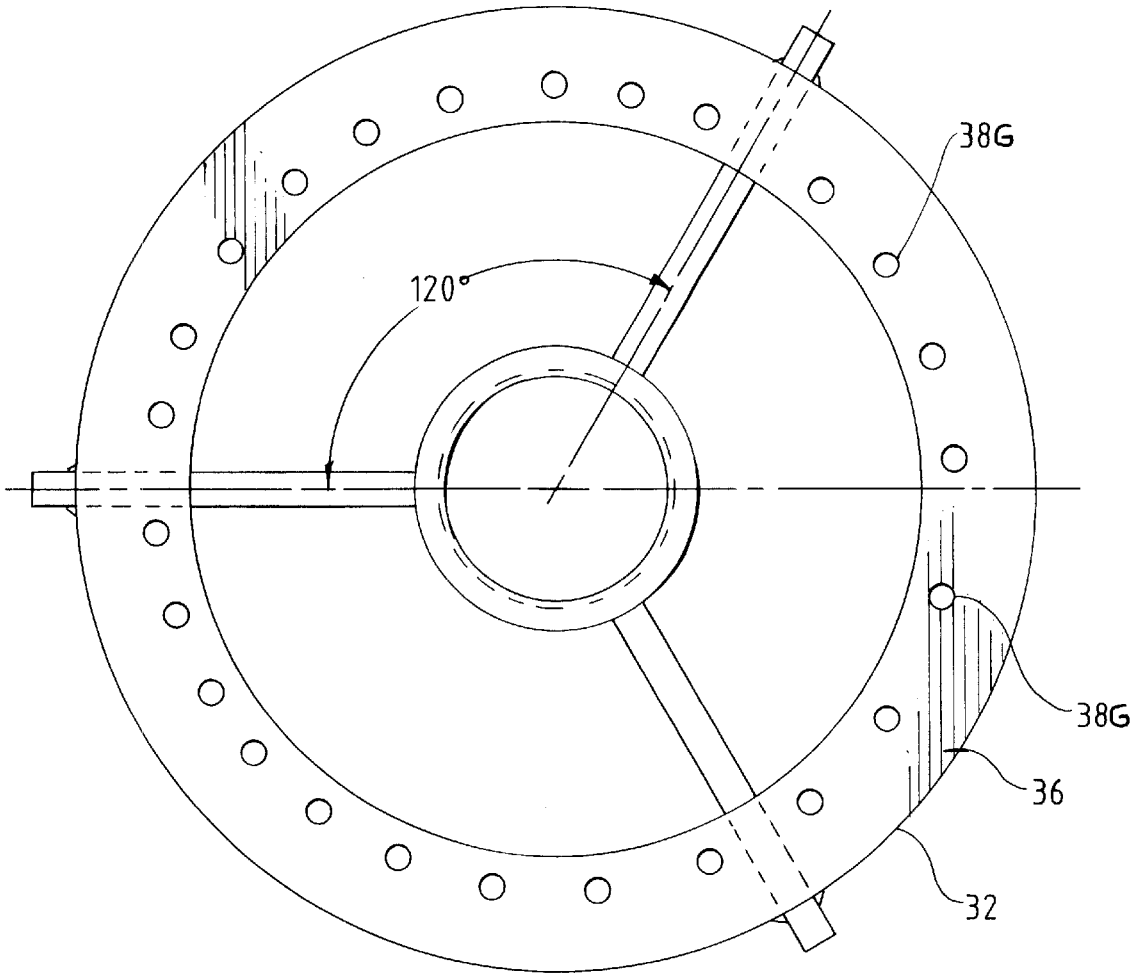
FIG. 10 is a bottom view of screen holder first flange of this invention.

As shown in FIG. 10 screen pilot 38 may be non-continuous. For example, when screen pilot 38 is made of a plurality posts 38G, the posts may be non-continuous and may be spaced at even or uneven intervals around bottom surface 36 of first flange 32.

An easy to manufacture screen pilot 38 is shown in FIGS. 3A–3C includes a first surface 56 and second surface 58 that are angled with respect to each other. While first surface 56 and second surface 58 may have any width, it is preferred that screen pilot first surface 56 has a greater width than second surface 58. It is also preferred that first surface 56 and second surface 58 define an angle Y, as shown in FIG. 3C, that ranges from about 60 to 120° and that is more preferably about 85–95°. Finally it is preferred that second surface 58 has an angle with respect to vertical that ranges from about 20 to about 40° and preferably about 30°.

Figure 4:
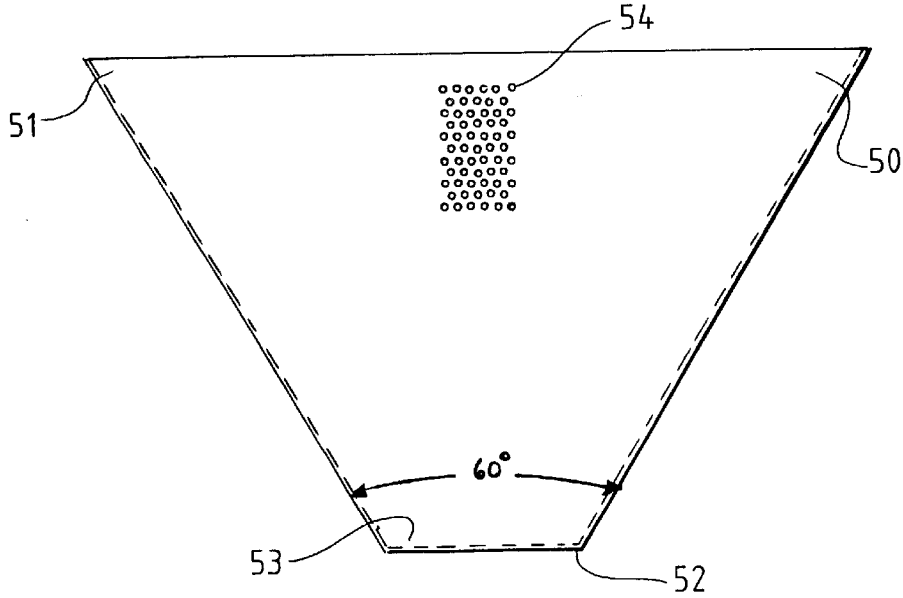
FIG. 4 is a side cut-away view of a frusto-conical screen useful in the present inventions.

A frusto-conical screen 26 useful in this invention is shown in FIG. 4. Frusto-conical screen 26 includes a large opening 50 and a small opening 52. Frusto-conical screen 26 further includes a plurality of perforations 54 that are preferably uniformly distributed over the screen surface. A typical size reduction machine may come supplied with a number of frusto-conical screens each having different sized perforations. The perforation sizes generally correlate to the particle size of product produced by size reduction machines. Additionally, the screen thickness can also be of various dimensions and effect the particle size and/or distribution.

An important feature of screens used with screen holders of this invention is their lack of flanges or bosses. Typical size reduction machines include screens that include flanges and/or bosses associated with the screen top edge and/or bottom edge. The flanges and bosses keep the screen from warping and help to precisely position and hold the screen with respect to the impeller. The screen holder of the present invention allows for the elimination of screen flanges and bosses. The screen holder of the present invention also corrects any screen warpage as the frusto-conical screen is positioned and compressively clamped between the screen holder and the drive housing cap. As a result, the size reduction machine of this invention uses screens that are less complex and easier to manufacture than prior art screens. Furthermore, the beginning position of the screen relative to the impeller is not important in machines of present invention because the impeller screen gap adjustment mechanism does not require a reproducible starting screen impeller gap.

As mentioned above, the size reduction machine of these inventions include a drive mechanism. While the inventions are described in conjunction with a right angle gearbox drive mechanism, such a drive mechanism is not mandatory. The inventions described herein achieve equivalent results when used with drive mechanisms such as belt drive mechanisms, chain drive mechanisms, flexible shaft drive mechanisms, direct connect or inline drive mechanisms and so forth. Furthermore, while the drive mechanisms described generally use an electric motor, the energy source may be hydraulic, pressurized air, water and so forth.

FIG. 6 is a side cross section view of a right angle gearbox drive mechanism useful in the size reduction machines of this invention. Right angle gearbox 22 includes a drive housing 101, driven gear 102, a driven gear key 103, a washer 104, screw 105 for attaching washer 104 to drive shaft 21, and an O-ring 106 providing a seal between drive housing 101 and drive housing cap 107. Right angle gearbox 22 further includes bearing 108, shim 109, seals 110, drive gear 112, drive gear key 113, bearing 114, shim 116, bearing 117, seal cap 118, seal 119, drive gear spacer 120, bearing 121, shim 122 and spacer 123. Drive housing cap 107 further includes a shoulder 124 shaped to accept counter bore 66 associated with impeller 28. Counter bore 66 surrounds shoulder 124 on housing cap 107 thereby inhibiting the migration of processed material into the impeller drive mechanism as a slinger/labyrinth seal.

Figure 5A:
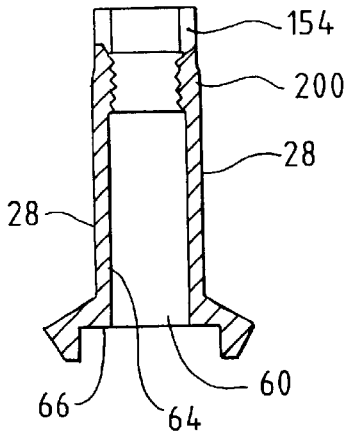
FIG. 5A is a side cut-away view of the center portion of an impeller useful in the present invention while 5B is a side view of an impeller useful in the present inventions.
Figure 5B:
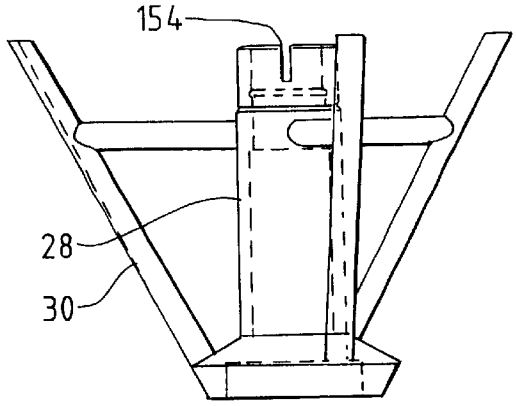

FIG. 5A is a side cut-away view of the hub portion 25 of an impeller 28 useful in this invention. FIG. 5B is a side view of an impeller 28 of this invention. Impeller hub 25 includes a central aperture 60 that is of sufficient size to allow impeller 28 to fit over impeller drive shaft 23. Impeller 28 should include at least one arm 30 and may include two or more arms. It is the distance between impeller arm 30 and screen 26 that is defined as the impeller screen gap. Preferably, impeller 28 will include two, three, or four arms 30 which may have various cross sectional dimensions. Arms 30 are set at an angle from vertical that is equal to the angle of frusto-conical screen 26 to insure that the impeller/screen gap is constant.

Figure 8A:
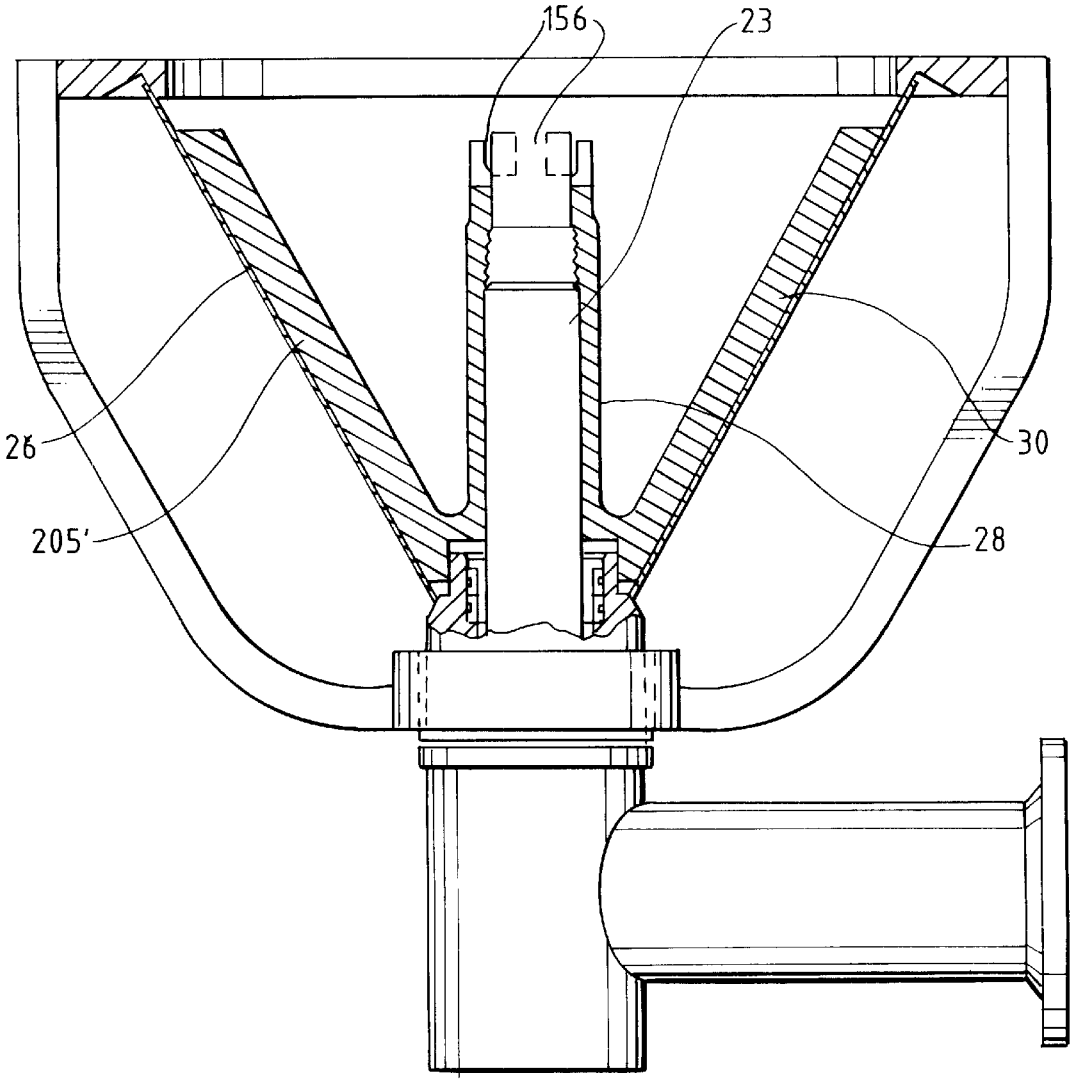
FIG. 8A is a cross section view of the impeller and frusto-conical screen showing the impeller to screen gap at zero.
Figure 8B:
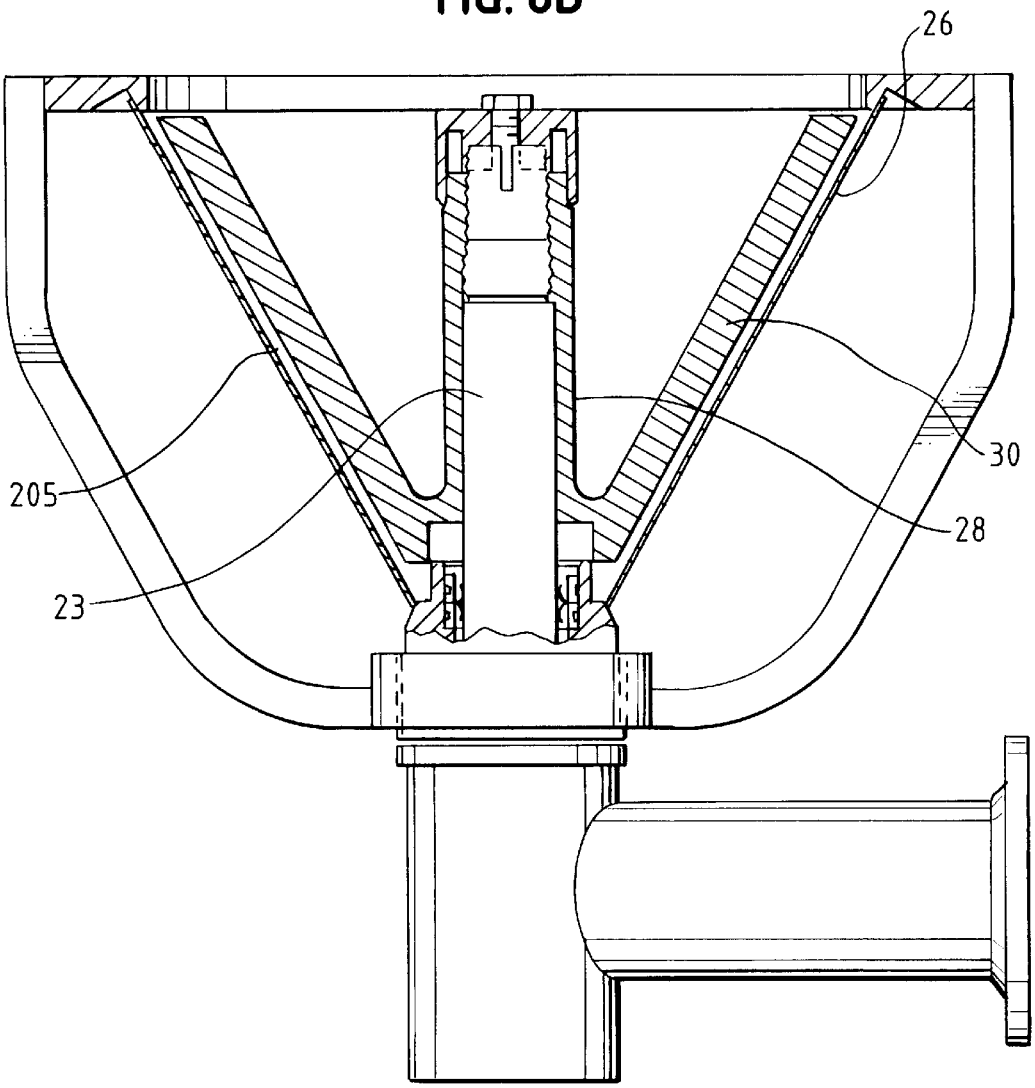
FIG. 8B is a cross section view of the impeller and frusto-conical screen after the impeller screen gap has been set.

FIGS. 8A and 8B are useful for understanding the operation of a gap adjustment mechanism of this invention. The gap adjustment mechanism of this invention is useful only when used in conjunction with a frusto-conical screen. As shown in the FIG. 6, impeller drive shaft 23 includes a threaded upper portion 202. As shown in FIGS. 5A and 5B, impeller central aperture inner surface 64 includes threaded portion 200. Impeller 28 is united with impeller drive shaft 23 by threading threaded portions 202 and 200 together. To set the screen gap, the screen gap must first be zeroed. This is accomplished by rotating impeller 28 towards drive housing cap 107 or rotating impeller drive shaft 23 while holding impeller 28 stationary until one or more impeller arms 30 first contact frusto-conical screen 26. At this point the gap 205 between impeller arm 30 and frusto-conical screen 26 is "zero"—there is no gap. The zeroed screen gap, 205', is shown in FIG. 8A.

Figure 7A:
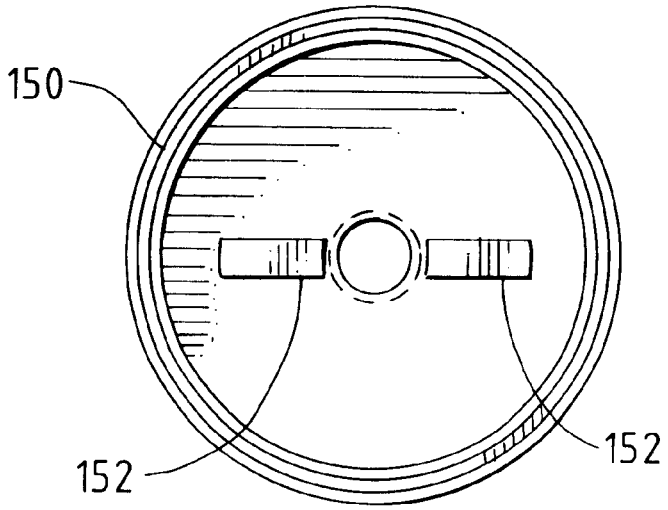
FIGS. 7A and 7B are bottom and side cut-away views respectively of an impeller adjuster useful in this invention.
Figure 7B:
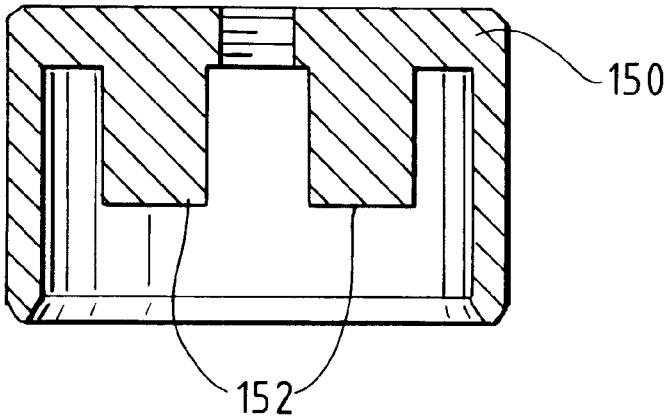

The impeller/screen gap is set by indexing impeller 28 in relation to impeller drive shaft 23. This is accomplished by partially disengaging impeller 28 from impeller drive shaft 23. In FIGS. 8A and 8B, disengaging is accomplished by partially unthreading impeller 28 from impeller drive shaft 23, one of which remains stationary during the procedure. As impeller 28 is unthreaded from impeller drive shaft 23, this distance between the frusto-conical screen 26 and arm 30 of impeller 28 begins to increase. The threading on the impeller drive shaft 202 and impeller inner surface 200 is preferably pitched such that a full or partial turn of the impeller 28 in relation to the impeller drive shaft 23 is equivalent to a known, incremental and repeatable gap between impeller arm 30 and frusto-conical screen 26. Once gap 205 is set, impeller 28 is secured to impeller drive shaft 23. A typical securing device is identified as 150 of FIGS. 7A and 7B. A size reduction machine with a set gap 205 is shown in FIG. 8B.

Impeller drive shaft 23 and impeller 28 may together include gauging mechanism for determining the movement of the impeller with respect to the impeller drive shaft and/or a lock for securing impeller 28 to impeller drive shaft 23 to ensure that rotation of the impeller drive shaft causes simultaneous rotation of the impeller. Preferably, the gauge and lock are the same mechanism. For example, impeller drive shaft 23 can be cross drilled with one or more holes that correspond to one or more slotted holes in the impeller hub. A cotter pin or some other pin can be placed through the holes to lock the impeller drive shaft to the impeller. Furthermore, the rotation of the impeller with respect to the impeller drive shaft can be determined by counting the number of times that the holes in the impeller and impeller drive shaft become aligned. Alternatively, complementary holes can be drilled into the end of the impeller drive shaft in the impeller hub and a locking device including pins can be used to secure the impeller drive shaft to the impeller. These are merely a few examples of devices that can be used to secure the impeller drive shaft to the impeller and also that can be used to gauge the relative rotation of the impeller with respect to the impeller drive shaft.

A preferred lock/gauge device is shown in FIGS. 7A, 7B, 8A and 8B. According to the figures, impeller drive shaft 23 and impeller 28 preferably include at least one complimentary slot. More specifically, impeller 28 preferably includes at least one slot 154 and impeller drive shaft 23 also includes at least one slot 156. The slots 154 and 156 are complementary to one another and become aligned at least once for each rotation of impeller 28 with respect to impeller drive shaft 23. When the impeller/screen gap is set, at least one slot 154 is aligned with at least one impeller drive shaft slot 156. Next an impeller adjuster key 150, which includes at least one key 152 complimentary to slots 154 and 156 is placed over impeller 28 such that key 152 fits into the aligned slots 154 and 156. Aligning key 152 with slots 154 and 156 prevents impeller drive shaft 23 from being rotated with respect to impeller 28. To further secure the assembly, a securing device such as a bolt 160 may be used to secure impeller adjuster key 150 to impeller drive shaft 23.

It is preferred that impeller 28 includes at least two and preferably four slots 154. By including additional slots finer gap adjustment resolution can be provided. The operator is able to use the alignment of slots as a reference to easily reproduce a known gap between impeller 28 and frusto-conical screen 26 by counting the number of times an impeller slot 154 passes a stationary impeller drive shaft slot 156 alignment position. Each adjacent aligned slot position relates to a known specific repeatable incremental gap change.

Another aspect of this invention is a size reduction machine that can be easily disassembled for cleaning. Referring back to FIG. 2, a preferred size reduction machine of this invention includes process housing 206 and motor housing 18. Process housing 206 includes an area 208 where process housing 206 is united with motor housing 18. Motor housing 18 and process housing 206 may be united in any manner that allows the two housings to be disengaged from one another. In a preferred embodiment shown in FIG. 2, an aperture 210 is machined in motor housing 18. A flattened portion 208 of process housing 206 fits over aperture 210 and the two housings are united using a clamp, connecting pins and the like. Process housing 206 is disengaged from motor housing 18 by disengaging the clamp or connecting pins and by also disengaging safety grid 212. Once disengagement is complete, process housing 206 may be separated from motor housing 18. The use of a spider coupling between motor 20 and drive shaft 21 facilitates separation of process housing 206 and motor housing 18. Once process housing 206 is separated from motor housing 18, the process housing 206 may be washed down, steamed or cleaned without fear of moisture contacting the electrical portion of the machine.

A problem with size reduction machines of the prior art is ejection of material from infeed hopper that is manually fed into the size reduction machine. Referring again to FIGS. 1 and 2, the size reduction machine of this invention will preferably include inlet feed hopper 16. Inlet feed hopper 16 will preferably include a safety grid 212. Safety grid 212 is a perforated cover that allows material to pass into the size reduction machine but prevents harmful ingress of fingers, hands, or ingress of contaminants and so forth into the size reduction machine. In order to prevent ejection of feed material from inlet feed hopper 16, safety grid bar 218 preferably includes an impervious ledge 220. Impervious ledge 220 prevents feed material from being ejected from the size reduction machine by acting as a dam. Any material that attempts to eject from inlet feed hopper 16 contacts impervious ledge 220, loses energy, and falls back into inlet feed hopper 16.

Yet another novel feature of this invention is a safety mechanism that prevents size reduction machines of this invention from being operated when the machine is not fully assembled. Referring once again to FIG. 2, the safety mechanism includes a safety switch 222 that must maintain contact in order for the size reduction machine to be operated. Once the contact is interrupted, the machine motor power is removed and cannot be operated. Preferably the safety switch is a coded magnetic safety switch that detects the proximity of a coded magnetic key. Safety switch 222 includes a stationary portion 226 and a removable portion 224. The stationary portion 226 is attached to a stationary bracket 228. The movable portion 224 is attached to safety grid bar 218 which is attached to safety grid 212. Moveable portion 224 is also associated with motor housing 18. When safety grid bar 218 is removed, the switch contact is broken and the machine becomes inoperable. Alternatively, if motor housing 18 is separated from process housing 206, the switch contact is broken and the machine becomes inoperable. The only time the machine is operable is when both process housing 206 is associated with motor housing 18 and safety grid bar 218 and safety grid 212 covers inlet feed hopper 16. Alternately, if the size reduction machine is to be incorporated on an in-line system without manual feeding, the safety grid is not utilized and safety grid bar is connected to the feed hopper or feeding device whichever provides necessary safety protection.

What we claim is:

1. A screen holder for use with a size reduction machine wherein the size reduction machine includes an impeller associated with an impeller drive shaft and a drive mechanism to rotate impeller shaft wherein the screen holder comprises;

a. a first flange having a top surface, a bottom surface and an opening wherein the first flange bottom surface includes a screen pilot;

b. a second flange having a second opening; and c. at least one support arm uniting the first flange with the second flange.

2. The screen holder of claim 1 wherein the screen pilot is a convex wall, a concave wall a straight wall, an angled wall, a channel, a plurality of posts or a combination thereof.

3. The screen holder of claim 1 wherein the screen pilot is non-continuous.

4. The screen holder of claim 1 wherein the screen pilot is a circular groove having a first surface and second surface wherein the first surface and the second surface intersect to define an angle of from 60 to about 120 degrees.

5. The screen holder of claim 1 wherein the first flange opening and second flange opening are circular.

6. The screen holder of claim 1 wherein the first opening is larger than the second opening.

7. A screen holder for use with a size reduction machine wherein the size reduction machine includes an impeller associated with an impeller drive shaft and a drive mechanism to rotate impeller shaft wherein the screen holder comprises;

a. a first flange having a top surface, a bottom surface and including a circular opening wherein the first flange bottom surface includes a screen pilot that comprises a circular groove including a first surface and a second surface that together define an angle of from 80 to about 100 degrees;

b. a second flange having a second circular opening wherein the second flange circular opening is smaller in diameter than the first flange circular opening; and c. at least one support arm uniting the first flange with the second flange.

* * * * *